US006409360B2

(12) United States Patent
Contant et al.

(10) Patent No.: US 6,409,360 B2
(45) Date of Patent: Jun. 25, 2002

(54) METRO CARD HOLDER, MAP, LIGHT AND CLOCK

(76) Inventors: Patricia Anne Contant, 93-19 215th St., Queens Village, NY (US) 11428; Dahved Levy Devonish, 166 Dekalb Ave., Brooklyn, NY (US) 11217

( * ) Notice: Subject to any disclaimer, the term of this patent is extended or adjusted under 35 U.S.C. 154(b) by 0 days.

(21) Appl. No.: 09/759,090

(22) Filed: Jan. 12, 2001

Related U.S. Application Data

(63) Continuation-in-part of application No. 09/551,773, filed on Apr. 18, 2000, now abandoned.

(51) Int. Cl.[7] ..... F21V 33/00; F21L 4/00
(52) U.S. Cl. ..... 362/154; 362/200; 362/253
(58) Field of Search ..... 362/189, 200, 362/208, 154, 109, 201, 253; 206/39, 39.6; 235/487; 150/147, 148

(56) References Cited

U.S. PATENT DOCUMENTS

| | | | | |
|---|---|---|---|---|
| 1,670,343 A | | 5/1928 | Clemens | |
| 4,141,400 A | * | 2/1979 | Mangan | 150/39.6 |
| 5,355,115 A | | 10/1994 | Goor et al. | 362/154 |
| 5,457,613 A | | 10/1995 | Vandenbelt et al. | 362/200 |
| 5,573,109 A | * | 11/1996 | Isacson | 362/116 |
| 5,893,631 A | * | 4/1999 | Padden | 362/201 |
| 5,927,846 A | * | 7/1999 | Sinclair | 362/189 |
| 6,039,454 A | * | 3/2000 | Halgrimsson | 362/200 |
| 6,070,990 A | * | 6/2000 | Dalton et al. | 362/201 |
| 6,109,762 A | * | 8/2000 | Hallgriimsson et al. | 362/201 |
| 6,145,994 A | * | 11/2000 | Ng | 362/119 |
| D442,869 S | * | 5/2001 | Leung | D10/140 |

OTHER PUBLICATIONS

Print Out of Web Page Http://www.lumatec.com/products/flashcrd.htm for Flashcard®Flashlight.

* cited by examiner

*Primary Examiner*—Sandra O'Shea
*Assistant Examiner*—Peggy A Neils
(74) *Attorney, Agent, or Firm*—Collard & Roe, P.C.

(57) ABSTRACT

A card holder comprising a first side and a second side joined together to form a substantially rectangular sleeve containing an open edge for receiving a planar flashlight. The first side of the sleeve contains a first pocket for receiving a card. This first pocket has an indent at the open edge to access the card using one's finger. The first side also contains an activation switch for the planar flashlight light. The second side of the sleeve contains a second pocket that holds a map of a transportation system. In addition, the metro card holder contains a digital clock on the second side. A light pipe or fiber optic strand runs from lighting elements contained in the planar flashlight to the digital clock thereby illuminating the clock.

4 Claims, 2 Drawing Sheets

METRO CARD HOLDER, MAP, LIGHT AND CLOCK

CROSS REFERENCE TO RELATED APPLICATIONS

This is a Continuation-in-Part application of Ser. No. 09/551,773 filed on Apr. 18, 2000 now abandoned.

BACKGROUND OF THE INVENTION

Field of the Invention

This invention relates to an improved card holder for debit cards that are used for subway and bus fares. More specifically, the invention relates to a card and map holder that contains a flashlight and a digital clock therein.

SUMMARY OF THE INVENTION

Debit cards or passes that are used to access public transportation have become more important in recent times. These cards are typically very thin and are shaped like a credit card. Therefore, it may be easy to misplace or lose them in a purse, wallet or pocket. This card holder helps prevent the loss of one's card as well as providing for easy access to the card when needed in a hurry. A further object of the present invention is to provide a map of the public transportation system for reference. In addition, a digital clock may be added to the second side of the card holder. This allows the user to gauge how much time he has until his next train.

These and other objects are accomplished by a card holder having a first side and a second side, wherein the first side is joined to the second side to form a rectangular sleeve with an open edge for receiving a planar flashlight. The planar flashlight is encased between the first side and second side. The preferred method for manufacturing the planar flashlight is described in U.S. Pat. No. 5,927,846, the disclosure of which is herein incorporated by reference.

The sleeve is preferably made of a translucent material, however other materials could be used. The first side of the sleeve contains a first pocket with an open edge for inserting a metro card therein and an indent at the open edge for accessing the metro card using one's finger tip. The first side also contains an activation switch for the flashlight. The second side contains a map of the transportation system for reference.

This metro card holder provides a convenient method of carrying a public transportation debit card and system map. The flashlight aids in finding items in the dark. This holder is small enough to fit inside a purse, pocket or wallet. Furthermore, the indent on the pocket allows for quick access to the metro card when needed.

BRIEF DESCRIPTION OF THE DRAWINGS

Other objects and features of the present invention will become apparent from the following detailed description considered in connection with the accompanying drawing. It is to be understood, however, that the drawing is designed as an illustration only and not as a definition of the limits of the invention.

In the drawing, wherein similar reference characters denote similar elements throughout the several views.

DETAILED DESCRIPTION OF THE PREFERRED EMBODIMENT

Figure 1:
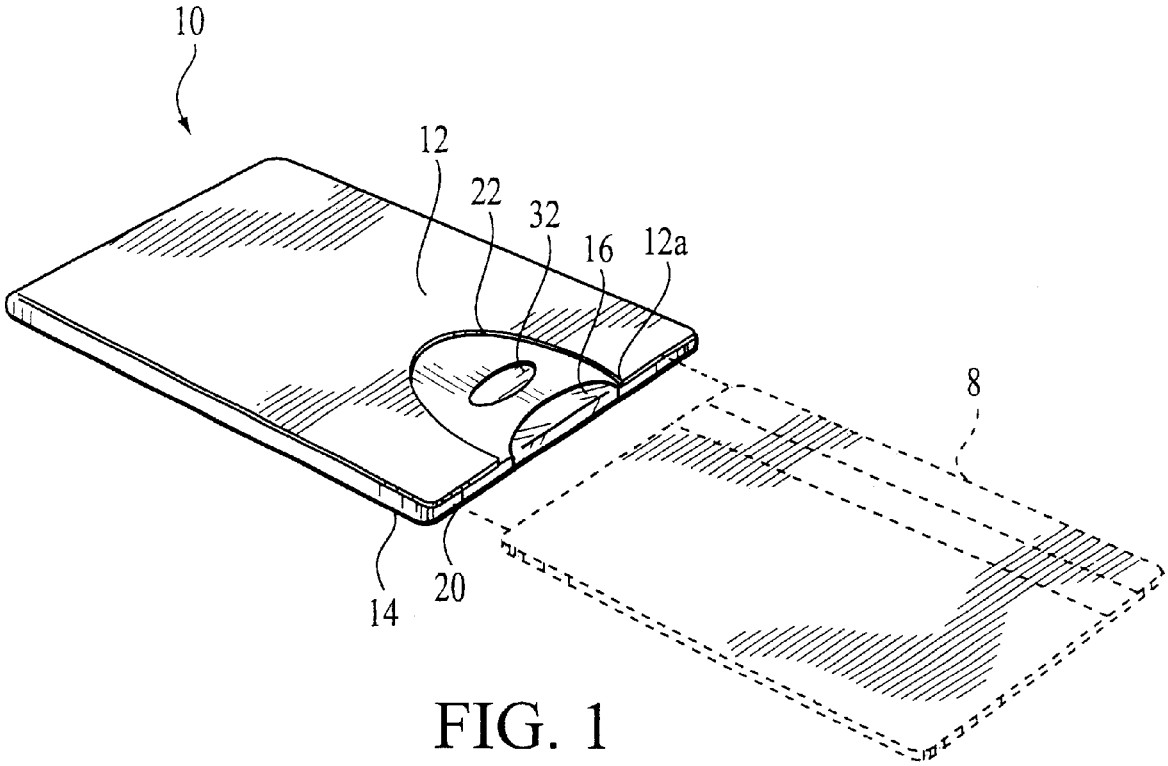
FIG. 1 shows a perspective view of the metro card holder according to the invention.
Figure 2:
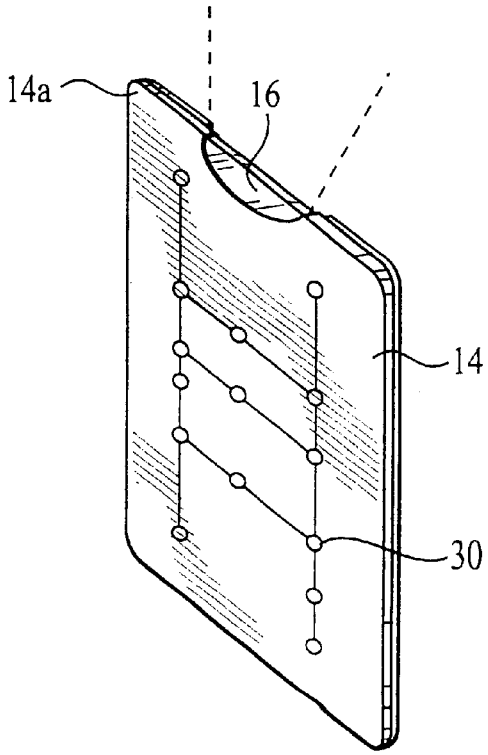
FIG. 2 shows a view of the second side of the metro card holder.

Referring now in detail to the drawing and, in particular FIG. 1 there is shown a metro card holder 10 having a substantially rectangular sleeve comprised of a first side 12 and a second side 14. A planar flashlight 16 is encased within the sleeve. First side 12 of the sleeve contains a first pocket 12*a* with an open edge 20. Metro card 8 slides into first pocket 12*a* of the sleeve through open edge 20. The open edge contains an indent 22 for retrieving metro card 8 when needed. Indent 22 allows for a finger tip to easily grasp the metro card to pull it out for use. In addition, button 32, which activates flashlight 16, is located on the second side of the sleeve. Pressing on this button activates planar flashlight 16 by closing an electrical circuit contained within planar flashlight 16. When the button is released, the circuit is opened and the flashlight turns off.

Second side 14 of the sleeve contains a second pocket 14*a* in which a metro system map 30 is encased. All edges of second pocket 14*a* are sealed. Therefore, map 30 is placed inside second pocket 14*a* at the time of manufacture.

Figure 3:
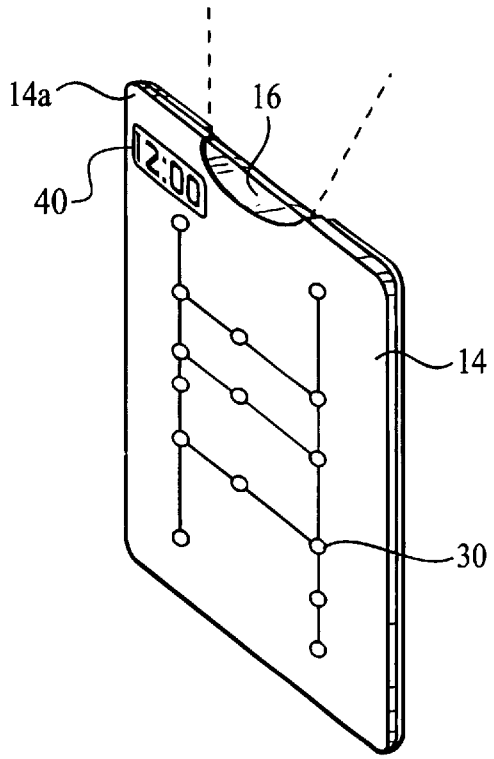
FIG. 3 shows a perspective view of another embodiment of the second side of the metro card holder.
Figure 4:
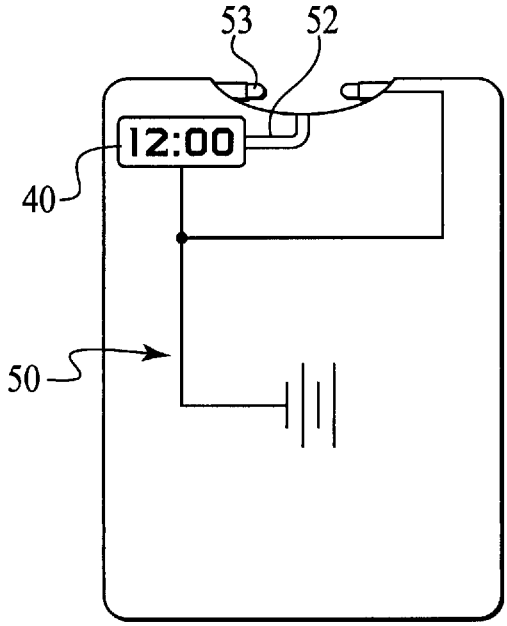
FIG. 4 shows a cut away view of the internal circuitry of the metro card holder.

FIG. 3 shows another embodiment of the metro card holder. In this case, the metro card holder contains a digital clock 40 on second side 14. First side 12 is the same as in FIG. 1. FIG. 4 shows the internal circuitry of metro card holder 10. Digital clock 40 receives power by connecting to the circuitry 50 of planar flashlight 16. In addition, a light pipe or fiber optic strand 52 runs from lighting elements 53 of planar flashlight 16 to digital clock 40 such that when button 32 is pressed, digital clock 40 is illuminated.

This card holder provides a convenient method of carrying a transportation card and system map. The user slides the metro card into the first pocket of the sleeve and refers the map in the second pocket for guidance. Indent 22 allows for quick access to the metro card when needed. Indent 22 is sized so that a finger tip can grasp the card in the sleeve to pull it out. Planar flashlight 16 aids in finding items in the dark and digital clock 40 allows the user to conveniently view the time. Furthermore, card holder 10 is small enough to fit inside a purse, pocket or wallet.

Accordingly, while only one embodiment of the present invention have been shown and described, it is obvious that many changes and modifications may be made thereunto without departing from the spirit and scope of the invention.

What is claimed is:

1. A card holder for receiving and storing a card and a transportation map comprising:

a) a first side;

b) a second side joined to said first side to form a substantially rectangular sleeve, said second side further comprising a digital clock having an action timer button;

c) a planar flashlight disposed within said substantially rectangular sleeve;

d) a first pocket disposed on said first side for receiving the card; and e) a second pocket disposed on said second side for receiving the transportation map, wherein said digital clock is connected to said planar flashlight such that said digital clock is illuminated when said activation button is pressed.

2. The card holder according to claim 1, wherein said first pocket further comprises an indent at said open edge for accessing the card using a finger.

3. The card holder according to claim 1, wherein said second pocket is sealed at all edges.

4. The card holder according to claim 1, wherein said substantially rectangular sleeve is made of a translucent material.

* * * * *